US007544459B2

(12) United States Patent
Sata et al.

(10) Patent No.: US 7,544,459 B2
(45) Date of Patent: Jun. 9, 2009

(54) PROCESS FOR PRODUCING A TONER

(75) Inventors: Shinichi Sata, Wakayama (JP); Yoshinobu Ishikawa, Wakayama (JP); Nobumichi Kamiyoshi, Wakayama (JP)

(73) Assignee: KAO Corporation, Tokyo (JP)

( * ) Notice: Subject to any disclaimer, the term of this patent is extended or adjusted under 35 U.S.C. 154(b) by 293 days.

(21) Appl. No.: 11/548,425

(22) Filed: Oct. 11, 2006

(65) Prior Publication Data

US 2007/0128533 A1 Jun. 7, 2007

(30) Foreign Application Priority Data

Oct. 14, 2005 (JP) ..... 2005-299660

(51) Int. Cl.
*G03G 9/08* (2006.01)

(52) U.S. Cl. ..... 430/137.14; 430/110.3; 430/137.1

(58) Field of Classification Search ..... 430/110.3, 430/137.1, 137.14
See application file for complete search history.

(56) References Cited

U.S. PATENT DOCUMENTS 7,056,636 B2 * 6/2006 Tomita et al. ..... 430/108.4
2003/0027066 A1 2/2003 Yamashita et al.
2006/0046175 A1 * 3/2006 Yoshida et al. ..... 430/108.7

FOREIGN PATENT DOCUMENTS

JP 2002-296839 10/2002
JP 2004-271686 9/2004

* cited by examiner

*Primary Examiner*—John L Goodrow
(74) *Attorney, Agent, or Firm*—Oblon, Spivak, McClelland, Maier & Neustadt, P.C.

(57) ABSTRACT

The present invention relates to a process for producing a toner which includes the steps of emulsifying a resin binder containing a polyester in an aqueous medium to prepare an emulsion of the resin binder and adding a water-soluble nitrogen-containing compound having a molecular weight of 350 or less to the emulsion obtained in the previous step to aggregate emulsified particles contained in the emulsion. According to the present invention, the shape of toner particles can be controlled simply for a short production time by using a resin binder containing a polyester and using substantially no organic solvent, and further a toner having a narrow and sharp particle size distribution can be produced.

23 Claims, No Drawings

PROCESS FOR PRODUCING A TONER

FIELD OF THE INVENTION

The present invention relates to a process for producing a resin emulsion suitably used for production of a toner for electrophotography which is employed in electrophotography, an electrostatic recording method, an electrostatic printing method or the like.

BACKGROUND OF THE INVENTION

It is conventionally known that chemical prepared toners are produced by a polymerization method or an emulsification dispersion method. Among these methods, when the toner is produced by the emulsification dispersion method, a mixture containing, for example, a resin binder and a colorant is mixed with an aqueous medium and emulsified therein to obtain toner particles. However, in the emulsification dispersion method, for example, when a polyester is used as the resin binder, there tend to arise problems such as a complicated procedure, prolonged production time and failure to control well the shape of the resulting toner particles. More specifically, in the conventional method, after the polyester is dissolved in an organic solvent and then emulsified in the aqueous medium, the organic solvent must be removed from the obtained emulsion, resulting in a complicated procedure. Also, as to control of the shape of toner particles, when a di- or higher-valent metal salt is used as an aggregating agent, only spherical particles are formed owing to a too strong aggregating force thereof, resulting in difficulty in suitably controlling the shape of the toner particles. On the other hand, when a monovalent metal salt such as potassium chloride is used as the aggregating agent, a prolonged production time is required owing to a too weak aggregating force thereof.

As techniques for producing a toner by emulsifying and dispersing a resin binder in an aqueous medium and then aggregating the thus emulsified resin particles, there have been proposed, for example, the process for producing a toner for developing an electrostatic latent image in the form of toner particles made of a resin and a colorant which are obtained by dispersing resin particles obtained by polyaddition reaction or polycondensation reaction in the aqueous medium to prepare a dispersion, and salting out/fusing the resin particles contained in the dispersion in the aqueous medium (refer to JP 2004-271686A), and the toner for electrophotography which is produced by melt-kneading a toner material containing a resin binder and a colorant, dissolving or dispersing the melt-kneaded toner material in an organic solvent capable of dissolving the resin binder therein or allowing the resin binder to be swelled therewith, emulsifying the resulting solution or dispersion in an aqueous medium, and then aggregating emulsified particles contained in the obtained emulsion (refer to JP 2002-296839A).

In any of these conventional techniques, the resin binder is emulsified using the organic solvent, and the aggregating agent made of a trivalent metal salt such as aluminum sulfate is used.

In addition, there has also been disclosed the process for producing a toner for developing an electrostatic latent image which includes an emulsifying step of emulsifying a mixture containing a polyester resin and an organic solvent in an aqueous medium to form fine particles of the mixture in the aqueous medium, and a coalescing step of successively adding a dispersion stabilizer and then an electrolyte to the resulting emulsion to coalesce the fine particles (refer to JP 2003-122051A). In this method, the emulsification treatment of the resin binder is also carried out using the organic solvent.

SUMMARY OF THE INVENTION

Thus, the present invention relates to a process for producing a toner which process includes the steps of: emulsifying a resin binder containing a polyester in an aqueous medium to prepare an emulsion of the resin binder; and adding a water-soluble nitrogen-containing compound having a molecular weight of 350 or less to the emulsion obtained in the previous step to aggregate emulsified particles contained in the emulsion; as well as a process for controlling the shape of toner particles which process includes adding a water-soluble nitrogen-containing compound having a molecular weight of 350 or less to an emulsion of a resin binder containing a polyester which is prepared by emulsifying the resin binder in an aqueous medium, and aggregating and coalescing emulsified particles contained in the emulsion.

DETAILED DESCRIPTION OF THE INVENTION

The present invention relates to a process for producing a toner which is capable of not only controlling the shape of resulting toner particles simply for a short production time, but also obtaining such a toner having a narrow particle size distribution, by using a resin binder containing a polyester and using substantially no organic solvent.

The resin binder used in the process for producing a toner according to the present invention contains a polyester from the viewpoints of good dispersibility of colorants, good fusing ability and good durability. The content of the polyester in the resin binder is preferably 60% by weight or more, more preferably 70% by weight or more and even more preferably 80% by weight or more from the viewpoints of good fusing ability and good durability. Examples of resins other than the polyester which may be contained in the resin binder include known resins used for production of toners such as styrene-acryl resins, epoxy resins, polycarbonates and polyurethanes.

The raw monomers of the polyester are not particularly limited, and there may be used a known alcohol component and a known carboxylic acid component such as a carboxylic acid, a carboxylic acid anhydride and a carboxylic acid ester.

Specific examples of the alcohol component include alkylene ($C_2$ to $C_3$) oxide adduct (average molar number of addition: 1 to 16) of bisphenol A such as polyoxypropylene-2,2-bis(4-hydroxyphenyl)propane and polyoxyethylene-2,2-bis(4-hydroxyphenyl)propane, and ethylene glycol, propylene glycol, glycerol, pentaerythritol, trimethylol propane, hydrogenated bisphenol A, sorbitol, and alkylene ($C_2$ to $C_4$) oxide adduct (average molar number of addition: 1 to 16) thereof. These alcohol components may be used alone or in combination of any two or more thereof.

Examples of the carboxylic acid component include dicarboxylic acids such as phthalic acid, isophthalic acid, terephthalic acid, fumaric acid, maleic acid, adipic acid and succinic acid; succinic acids substituted with an alkyl group having 1 to 20 carbon atoms or an alkenyl group having 2 to 20 carbon atoms such as dodecenyl succinic acid and octenyl succinic acid; tri- or higher-valent polycarboxylic acids such as trimellitic acid and pyromellitic acid; and anhydrides and alkyl ($C_1$ to $C_3$) esters of these acids. These carboxylic acid components may be used alone or in combination of any two or more thereof.

The polyester may be produced, for example, by polycondensing the alcohol component and the carboxylic acid component in an inert gas atmosphere at a temperature of 180 to 250° C., if required, in the presence of an esterification catalyst.

From the viewpoint of the good keeping property of the resultant toner, the polyester preferably has a softening point of 80 to 165° C. and a glass transition temperature of 50 to 85° C. The acid value of the polyester is preferably from 6 to 35 mg KOH/g, more preferably from 10 to 35 mg KOH/g and even more preferably from 15 to 35 mg KOH/g from the viewpoint of facilitated production of the emulsion. The softening point, the glass transition temperature and the acid value of the polyester may be desirably adjusted by controlling the temperature and time used in the polycondensation reaction.

Also, from the viewpoint of good chargeability, it is preferred to use such a polyester obtained by using, as the acid component, an aromatic carboxylic acid such as terephthalic acid, trimellitic acid, isophthalic acid and anhydrides of these acids in combination with an aliphatic carboxylic acid such as fumaric acid, adipic acid, succinic acid and derivatives and anhydrides of these acids.

The resin binder preferably has the same softening point, glass transition temperature and acid value as those of the polyester.

The process for producing a toner according to the present invention, includes the step of emulsifying the resin binder containing the above polyester in an aqueous medium (emulsifying step), and the step of adding a water-soluble nitrogen-containing compound having a molecular weight of 350 or less to an emulsion of the resin binder obtained in the emulsifying step to aggregate emulsified particles contained in the emulsion (aggregating step). The emulsifying step and the aggregating step are explained in detail below.

[Emulsifying Step]

The aqueous medium used in the emulsifying step may contain a solvent such as organic solvents, an inorganic salt such as alkali metal salts, or the like. The water content in the aqueous medium is preferably 95% by weight or more and more preferably 99% by weight or more. In particular, in the present invention, when the aqueous medium is composed of water solely using substantially no organic solvent, the resin binder can be dispersed therein in the form of fine particles.

In the emulsifying step, from the viewpoints of good emulsification stability of the resin binder, etc., a surfactant may be present in an amount of preferably 5 parts by weight or less, more preferably from 0.1 to 3.5 parts by weight and even more preferably from 0.1 to 3 parts by weight on the basis of 100 parts by weight of the resin binder.

Examples of the surfactant include anionic surfactants such as sulfate-based surfactants, sulfonate-based surfactants, phosphate-based surfactants and soap-based surfactants; cationic surfactants such as amine salt-type surfactants and quaternary ammonium salt-type surfactants; and nonionic surfactants such as polyethylene glycol-based surfactants, alkyl phenol ethyleneoxide adduct-based surfactants and polyhydric alcohol-based surfactants. Among these surfactants, preferred are ionic surfactants such as anionic surfactants and cationic surfactants. The nonionic surfactant is preferably used in combination with the anionic surfactant or the cationic surfactant. These surfactants may be used alone or in combination of any two or more thereof. Specific examples of the anionic surfactants include sodium dodecylbenzenesulfonate, sodium dodecylsulfate, sodium alkylethersulfate, sodium alkylnaphthalenesulfonate and sodium dialkylsulfosuccinate. Specific examples of the cationic surfactants include alkylbenzenedimethyl ammonium chloride, alkyltrimethyl ammonium chloride and distearyl ammonium chloride.

Also, in the emulsifying step, the resin binder is preferably dispersed in the aqueous medium by adding an aqueous alkali solution thereto in an amount equivalent to that of an acid group of the polyester contained in the resin binder.

Upon the emulsifying step, there may also be used a colorant, a master batch of the colorant, a charge control agent, a releasing agent such as waxes, etc. Meanwhile, the resin binder may be dispersed not only in the form of a binder in itself, but also in the form of granules obtained by previously melt-kneading the resin binder with the above raw materials required for preparation of the toner.

The aqueous alkali solution used for dispersing the resin binder preferably has a concentration of from 1 to 20% by weight, more preferably from 1 to 10% by weight and even more preferably from 1.5 to 7.5% by weight. As the alkali of the aqueous alkali solution, there may be used such an alkali capable of enhancing a surface activity of its salt formed from the polyester. Examples of the alkali include a hydroxide of a monovalent alkali metal such as potassium hydroxide and sodium hydroxide.

After dispersing the resin binder in the aqueous medium, the resulting dispersion is neutralized at a temperature not lower than the glass transition temperature of the resin binder, and then water is added thereto at a temperature not lower than the glass transition temperature of the resin binder to cause a phase inversion and emulsify the resin binder, thereby preparing an emulsion of the resin binder.

The rate of addition of water as the aqueous medium is preferably from 0.5 to 50 g/min, more preferably from 0.5 to 40 g/min and even more preferably from 0.5 to 30 g/min per 100 g of the resin from the viewpoint of efficient emulsification of the resin binder. The rate of addition of water may be usually maintained until an O/W type emulsion is substantially formed. Therefore, the rate of addition of water after forming the O/W type emulsion is not particularly limited.

From the viewpoint of preparing an emulsion containing fine resin particles, the above emulsifying step is preferably conducted at a temperature not lower than the glass transition temperature of the resin binder and not higher than the softening point thereof. When the emulsification is conducted in the above-specified temperature range, the resin binder can be smoothly emulsified in the aqueous medium, and any special apparatus is not required therefor. From these viewpoints, the temperature used for the emulsification is a temperature not lower than the glass transition temperature +(plus) 10° C. and not higher than the softening point −(minus) 5° C. Meanwhile, when the resin binder is in the form of a mixture of resins, the softening point of a mixed resin obtained by mixing the respective resins at a predetermined ratio and melting the resulting mixture is regarded as the softening point of the resin binder. In addition, when a master batch is used in the resin binder, the softening point of a mixed resin composed of respective resins including the master batch is regarded as the softening point of the resin binder.

The volume-median particle size ($D_{50}$) of the emulsified particles obtained after forming the O/W type emulsion is preferably from 0.02 to 2 μm, more preferably from 0.05 to 1 μm and even more preferably from 0.05 to 0.6 μm for the purpose of uniformly aggregating the emulsified particles in the subsequent aggregating step. Meanwhile, the volume-median particle size ($D_{50}$) used herein means a particle size at which a cumulative volume frequency calculated from a smaller particle size side on the basis of a volume fraction is 50%, and may be measured by the below-mentioned method.

The solid content of the thus prepared resin emulsion is preferably from 7 to 50% by weight, more preferably from 7 to 45% by weight and even more preferably from 10 to 40% by weight from the viewpoints of good stability of the resulting emulsion and good handling property of the resin emulsion in the subsequent aggregating step.

The thus prepared resin emulsion is then subjected to the step of aggregating and coalescing the emulsified particles contained therein (hereinafter occasionally referred to as "primary particles").

[Aggregating Step]

In the aggregating step, for the purpose of controlling the aggregating rate and the shape of the resultant toner, the resin binder is preferably aggregated in the presence of a surfactant. When the surfactant is already added in the previous emulsifying step, it is not necessarily required to further add the surfactant. However, an additional amount of the surfactant may be added in the aggregating step, if required. In the aggregating step, the amount of the surfactant being present in the reaction system is preferably 5 parts by weight or less, more preferably 4.5 parts by weight or less and even more preferably 3.5 parts by weight or less on the basis of 100 parts by weight of the resin binder from the viewpoint of good chargeability of the resultant toner, and preferably 0.5 part by weight or more and more preferably 1 part by weight or more on the basis of 100 parts by weight of the resin binder from the viewpoint of good productivity and a well-controlled shape of the resultant toner. Namely, the amount of the surfactant being present in the aggregating step is preferably 5 parts by weight or less, more preferably from 0.5 to 4.5 parts by weight and even more preferably from 0.5 to 3.5 parts by weight on the basis of 100 parts by weight of the resin binder.

The solid content of the reaction system in the aggregating step may be adjusted by adding water to the emulsion of the resin binder, and is preferably from 5 to 50% by weight, more preferably from 5 to 40% by weight and even more preferably from 5 to 35% by weight in order to ensure uniform aggregation of the resin binder.

The pH of the reaction system in the aggregating step as measured at 25° C. is preferably from 5 to 8.5, more preferably from 5 to 7 and even more preferably from 5 to 6.5 from the viewpoint of satisfying both good dispersion stability of the emulsion and good aggregating property of fine particles of the resin binder, the colorant, etc. In the present invention, upon adding the below-mentioned water-soluble nitrogen-containing compound having a molecular weight of 350 or less, the pH of the emulsion of the resin binder as measured at 25° C. is preferably maintained at the above value.

From the same viewpoint, the temperature of the reaction system in the aggregating step is preferably not lower than a temperature calculated from the softening point of the resin binder −(minus) 50° C. but not higher than a temperature calculated from the softening point −(minus) 10° C., and more preferably not lower than a temperature calculated from the softening point of the resin binder −(minus) 30° C. but not higher than a temperature calculated from the softening point −(minus) 10° C.

Meanwhile, upon aggregating the primary particles, only the primary particles obtained in the emulsifying step in which the colorant, etc., are charged, may be aggregated (homo-aggregation). Alternatively, the water dispersion of the colorant, the dispersion of the fine resin particles obtained in the emulsifying step, etc., may be mixed with the dispersion of the primary particles to aggregate the primary particles with the other fine resin particles (hetero-aggregation).

In the above aggregating step, the water-soluble nitrogen-containing compound having a molecular weight of 350 or less is added as an aggregating agent, thereby enabling simple production of the toner having excellent environmental resistance, chargeability and keeping property. The term "water-soluble" of the "water-soluble nitrogen-containing compound" used in the present invention means that the compound has a solubility in water of 10% by weight or more as measured at 25° C. The aggregating agent may be used in combination with other known aggregating agents, if required. In this case, since the water-soluble nitrogen-containing compound having a molecular weight of 350 or less is used as a main aggregating agent, a cation of the nitrogen-containing compound is present in an amount of preferably one equivalent or more and more preferably 1.5 equivalents or more per an equivalent of an acid group contained in the polyester.

The water-soluble nitrogen-containing compound having a molecular weight of 350 or less is preferably an acidic compound, and an aqueous solution containing 10% by weight of the water-soluble nitrogen-containing compound exhibits a pH of preferably from 4 to 6 and more preferably from 4.2 to 6 as measured at 25° C. from the viewpoint of rapid aggregation of the polyester particles. The water-soluble nitrogen-containing compound has a molecular weight of 350 or less and preferably 300 or less from the viewpoint of good chargeability, etc., even under high-temperature and high-humidity conditions. Examples of the water-soluble nitrogen-containing compound include ammonium salts such as ammonium halides, ammonium sulfate, ammonium acetate, ammonium benzoate and ammonium salicylate; and quaternary ammonium salts such as tetraalkyl ammonium halides. Among these compounds, from the viewpoint of good productivity, preferred are ammonium sulfate (pH value of 10 wt % aqueous solution thereof as measured at 25° C. (hereinafter referred to merely as "pH"): 5.4), ammonium chloride (pH: 4.6) tetraammonium bromide (pH: 5.6) and tetrabutylammonium bromide (pH: 5.8). These water-soluble nitrogen-containing compounds may be used alone or in combination of any two or more thereof.

The water-soluble nitrogen-containing compound having a molecular weight of 350 or less may be used in an amount of preferably 50 parts by weight or less, more preferably 40 parts by weight or less and even more preferably 30 parts by weight or less on the basis of 100 parts by weight of the resin binder from the viewpoint of good chargeability of the toner, in particular, good chargeability even under high-temperature and high-humidity conditions, and preferably 2 parts by weight or more, more preferably 3.5 parts by weight or more and even more preferably 5 parts by weight or more on the basis of 100 parts by weight of the resin binder from the viewpoint of good aggregating property In consideration of these viewpoints, the amount of the water-soluble nitrogen-containing compound used is from 3.5 to 40 parts by weight and more preferably from 5 to 30 parts by weight on the basis of 100 parts by weight of the resin binder.

In addition, not only the amount of the water-soluble nitrogen-containing compound used but also the concentration of the water-soluble nitrogen-containing compound contained in the reaction system within the toner production vessel should be noted. At the time at which the water-soluble nitrogen-containing compound is charged into the production vessel, the concentration of the water-soluble nitrogen-containing compound therein is preferably from 0.01 to 0.5 mol/L and more preferably from 0.05 to 0.45 mol/L per 1 L of water contained in the emulsion.

Conventionally, ammonium sulfate has been used to rapidly transfer the resin binder dissolved in the aqueous medium containing an organic solvent into the oil phase by utilizing a charge repulsion of an anion in an electrolyte (salting-out by electrolyte). On the other hand, in the present invention, by noticing a terminal carboxylic acid contained in the polyester which is present in the aqueous system containing substantially no organic solvent, etc., a charge attraction force of a cation of ammonium sulfate which tends to be rapidly ionically bonded to or ionically absorbed in the carboxyl ion is utilized. Thus, the conventional method and the present invention are quite different in technical concept from each other.

In the present invention, from the viewpoint of less energy consumption, the water-soluble nitrogen-containing compound having a molecular weight of 350 or less is preferably added to the emulsion of the resin binder at a temperature less than the glass transition temperature of the resin binder. The addition of the water-soluble nitrogen-containing compound to the emulsion of the resin binder is more preferably conducted at room temperature without using any heating and cooling energy, etc.

Further, from the viewpoint of easiness of controlling the shape of the toner particles, the water-soluble nitrogen-containing compound having a molecular weight of 350 or less is preferably added to the emulsion of the resin binder at a temperature not lower than the glass transition temperature of the resin binder.

The aggregating agent such as the water-soluble nitrogen-containing compound having a molecular weight of 350 or less is preferably added in the form of a solution prepared by dissolving the aggregating agent in an aqueous medium. Upon or after the addition of the aggregating agent, the resultant mixture is preferably fully stirred.

In the present invention, successively, the aggregated particles containing at least the resin binder and the colorant which are obtained in the above aggregating step are heated and unified.

The heating temperature used upon coalescing the aggregated particles is preferably not lower than a temperature calculated from the softening point of the resin binder −(minus) 55° C. but not higher than a temperature calculated from the softening point of the resin binder +(plus) 10° C., more preferably not lower than a temperature calculated from the softening point of the resin binder −(minus) 50° C. but not higher than a temperature calculated from the softening point +(plus) 10° C., and even more preferably not lower than a temperature calculated from the softening point of the resin binder −(minus) 40° C. but not higher than a temperature calculated from the softening point of the resin binder +(plus) 10° C. from the viewpoint of controlling the particle size, and particle size distribution, having a well-controlled shape, and good fusibility of the particles of the aimed toner. In addition, the stirring velocity is preferably a velocity at which the aggregated particles are not precipitated.

In the present invention, when the above-specified temperature upon the coalescing procedure is held for a predetermined period of time, the shape of the toner is changed from the aggregated particles to the unified particles.

The unified particles obtained in the above aggregating and coalescing step may be appropriately subjected to a liquid-solid separation step such as filtration, a washing step and a drying step, thereby obtaining the aimed toner.

In the washing step, the unified particles are preferably washed with an acid to remove metal ions from the surface of the respective toner particles for the purpose of ensuring sufficient chargeability and reliability of the resultant toner. Further, a nonionic surfactant, if added, is preferably completely removed from the unified particles by washing. For this purpose, the unified particles are preferably washed with an aqueous solution at a temperature not higher than a cloud point of the nonionic surfactant. The washing procedure is preferably carried out several times.

In addition, in the drying step, any optional methods such as vibration-type fluidizing drying method, spray-drying method, freeze-drying method and flash jet method can be employed. The water content of the toner after drying is preferably adjusted to 1.5% by weight or less and more preferably 1.0% by weight or less from the viewpoint of good chargeability of the resulting toner.

In accordance with the present invention, it is possible to obtain a toner having a spherical shape, a small particle size and a narrow and sharp particle size distribution which is suitably used to form images having a high accuracy and a high quality.

The volume-median particle size ($D_{50}$) of the toner is preferably from 1 to 7 μm, more preferably from 2 to 7 μm and even more preferably from 3 to 6 μm from the viewpoints of high image quality and good productivity.

In addition, the toner preferably has a softening point of from 60 to 140° C., more preferably from 60 to 130° C. and even more preferably from 60 to 120° C. from the viewpoint of good low-temperature fusing ability. In addition, the toner preferably has a maximum endothermic peak temperature as measured by a differential scanning calorimeter of from 60 to 140° C., more preferably from 60 to 130° C. and even more preferably from 60 to 120° C. from the same viewpoint.

In the toner obtained by the present invention, an external additive such as a fluidizing agent can be added to the surface of the toner particles. As the external additive, there may be used known fine particles. Examples of the fine particles include inorganic fine particles such as fine silica particles whose surface is subjected to a hydrophobic treatment, fine titanium oxide particles, fine alumina particles, fine cerium oxide particles and carbon blacks; and fine polymer particles such as polycarbonates, polymethyl methacrylate and silicone resins.

The number-average particle size of the external additive is preferably from 4 to 200 nm, more preferably from 8 to 100 nm and even more preferably from 8 to 50 nm. The number-average particle size of the external additive may be determined using a scanning type electron microscope or a transmission type electron microscope.

The amount of the external additive formulated is preferably from 1 to 5 parts by weight and more preferably from 1.5 to 3.5 parts by weight on the basis of 100 parts by weight of the toner before being treated with the external additive. When hydrophobic silica is used as the external additive, the hydrophobic silica is preferably added in an amount of from 1 to 3 parts by weight on the basis of 100 parts by weight of the toner before being treated with the external additive, thereby attaining desired effects.

The toner for electrophotography obtained according to the present invention can be used as a non-magnetic one-component system developer, or can be mixed with a carrier to form a two-component system developer.

[Method for Controlling Shape of Toner Particles]

The present invention also relates to a method for controlling the shape of toner particles. In the method of the present invention, a water-soluble nitrogen-containing compound having a molecular weight of 350 or less is added to an emulsion of a resin binder obtained by emulsifying the resin binder containing a polyester in an aqueous medium to aggregate and coalesce emulsified particles contained in the emulsion, thereby controlling the shape of the toner particles.

The aqueous medium, the resin binder, the emulsifying step for the resin binder, the water-soluble nitrogen-containing compound having a molecular weight of 350 or less and the aggregating and coalescing step are the same as described above.

In the method for controlling the shape of toner particles according to the present invention, by allowing the particles to stand at the above aggregating temperature for a predetermined period of time in the aggregating step, the shape of the toner can be changed from the aggregated particle shape to the unified particle shape. For example, when the aggregating temperature and time as well as the amount of the surfactant added are appropriately adjusted, the configuration of the resultant toner can be broadly varied from a spherical shape to a non-spherical shape. As the aggregating time is longer and as the aggregating temperature is higher, the shape of the toner is more approachable to a spherical shape. In addition, a force at a boundary between water and the resin binder (boundary tension) tends to be varied depending upon the amount of the surfactant used. Therefore, it is considered that the shape of the toner is controllable by adjusting the amount of the surfactant used.

In accordance with the present invention, the shape of the toner particles can be controlled simply for a short production time by using the resin binder containing a polyester but using substantially no organic solvent nor a compound containing metals such as iron and aluminum. Further, in accordance with the present invention, it is possible to produce such a toner exhibiting an excellent chargeability even under high-temperature and high-humidity conditions.

Thus, in the process for producing the toner according to the present invention, the particle size of the toner can be controlled simply for a short production time substantially without using any organic solvent. The toner thus produced by the process of the present invention can be suitably used as a toner for electrophotography.

The present invention is described in more detail by referring to the following examples. However, it should be noted that these examples are only illustrative and not intended to limit the invention thereto.

Various properties were measured and evaluated by the following methods.

[Acid Value of Resin]

Determined according to JIS K0070.

[Softening Point, Maximum Endothermic Peak Temperature, Melting Point and Glass Transition Point of Resin and Toner]

(1) Softening Point

The softening point refers to a temperature at which half the amount of the sample flows out when plotting a downward movement of a plunger against temperature, as measured by using a flow tester "CFT-500D," commercially available from Shimadzu Corporation, in which 1 g of the sample is extruded through a nozzle having a die pore size of 1 mm and a length of 1 mm while heating the sample so as to raise the temperature at a rate of 6° C./min and applying a load of 1.96 MPa thereto with the plunger.

(2) Maximum Endothermic Peak Temperature and Melting Point

The maximum endothermic peak temperature of the sample is determined using a differential scanning calorimeter ("DSC 210" commercially available from Seiko Instruments, Inc.) by raising its temperature at a rate of 10° C./min, after raising the temperature of the sample to 200° C., and cooling the hot sample from this temperature to 0° C. at a cooling rate of 10° C./min. Among the endothermic peaks observed, the temperature of an endothermic peak on the highest temperature side is defined as the maximum endothermic peak temperature. When a difference between the maximum endothermic peak temperature and the softening point is within 20° C., the peak temperature is defined as a melting point. When the maximum endothermic peak temperature is equal to or lower than the temperature calculated from the softening point −(minus) 20° C., the peak is ascribed to glass transition.

(3) Glass Transition Temperature

The glass transition temperature of the sample is determined using a differential scanning calorimeter ("DSC 210" commercially available from Seiko Instruments, Inc.) by raising its temperature at a rate of 10° C./min, after raising the temperature of the sample to 200° C., and cooling the hot sample from this temperature to 0° C. at a cooling rate of 10° C./min. When a peak is observed at a temperature equal to or lower than the temperature calculated from the softening point −(minus) 20° C., the peak temperature thereof is read off as a glass transition temperature, and when a shift of the curve is observed without any observations of peaks at a temperature equal to or lower than the temperature calculated from the softening point −(minus) 20° C., the temperature of an intersection of the tangential line having the maximum inclination of the curve in the portion of the curve shift and the extended baseline of the high-temperature side of the curve shift is read off as a glass transition temperature. The glass transition temperature is a property inherently owned by the amorphous portion in the resin, which may be generally observed in an amorphous polyester, or may be also observed in an amorphous portion of a crystalline polyester in some cases.

[Number-Average Molecular Weight of Resin]

The number-average molecular weight is obtained from the molecular weight distribution determined by the gel permeation chromatography according to the following method.

(1) Preparation of Sample Solution

The sample is dissolved in tetrahydrofuran to prepare a solution having a concentration of 0.5 g/100 mL. The resulting solution is then filtered with a fluororesin filter ("FP-200," commercially available from Sumitomo Electric Industries, Ltd.) having a pore size of 2 μm to remove insoluble components therefrom, thereby obtaining a sample solution.

(2) Determination of Molecular Weight

While allowing tetrahydrofuran as an eluent to flow at a rate of 1 mL/min, a column is stabilized in a thermostat at 40° C. One-hundred microliters of the sample solution is injected into the column to determine a molecular weight of the sample. The molecular weight of the sample is calculated on the basis of a calibration curve previously prepared. The calibration curve of the molecular weight is prepared by using several kinds of monodisperse polystyrenes (those having a molecular weight of $2.63\times10^3$, $2.06\times10^4$ and $1.02\times10^5$ available from Tosoh Corporation; and those having a molecular weight of $2.10\times10^3$, $7.00\times10^3$ and $5.04\times10^4$ available from GL Science Co., Ltd.) as standard samples.

Analyzer: CO-8010 (commercially available from Tosoh Corporation)

Column: GMHLX+G3000HXL (commercially available from Tosoh Corporation)

[Particle Size of Dispersed Resin]

Measuring Apparatus: Laser diffraction particle size analyzer ("LA-920" commercially available from Horiba Seisakusho Co., Ltd.)

Measuring Conditions: A cell for the determination is charged with distilled water and a volume-median particle size ($D_{50}$) is determined at a temperature at which its absorbance is within a proper range.

[Particle Size of Toner]

(1) Preparation of Dispersion

Ten milligrams of a sample to be measured is added to 5 mL of a dispersion (a 5% by weight aqueous solution of "EMULGEN 109P" (commercially available from Kao Corporation; polyoxyethylene lauryl ether; HLB value: 13.6)), and dispersed with an ultrasonic disperser for one minute. Thereafter, 25 mL of an electrolytic solution ("Isotone II" (commercially available from Beckman Coulter)) is added thereto, and the mixture is further dispersed with the ultrasonic disperser for one minute to obtain a dispersion.

(2) Measuring Apparatus: Coulter Multisizer II (Commercially Available from Beckman Coulter)

Aperture Diameter: 100 μm

Range of Particle Sizes to Be Determined: 2 to 40 μm

Analyzing Software: Coulter Multisizer AccuComp Ver. 1.19 (commercially available from Beckman Coulter)

(3) Measuring Conditions

One-hundred milliliters of an electrolyte and a dispersion are added to a beaker, and the particle sizes of 30000 particles are determined under the conditions for concentration satisfying that the determination for 30000 particles are completed in 20 s to determine a volume-median particle size ($D_{50}$) thereof. Further, the CV value is calculated according to the following formula:

$$\text{CV Value (\%)} = (\text{Standard Deviation of Particle Size Distribution/Volume-Median Particle Size}) \times 100$$

[Circularity of Toner]

(1) Preparation of Dispersion: The dispersion was prepared by the same method as described in the above column "Particle Size of Toner".

(2) Measuring Apparatus: "FPIA-3000" commercially available from Sysmex Corporation.

(3) Measuring Conditions: Using "Particle Sheath" as a sheath liquid to be measured, the sample was repeatedly measured 5 times in a HPF measuring mode to obtain an average circularity of the toner.

[Chargeability]

Two polymer bottles each having a capacity of 20 mL were respectively charged with 0.6 g of the toner and 9.4 g of a silicone-coated ferrite carrier having an average particle size (volume-median particle size ($D_{50}$)) of 60 μm (commercially available from Kanto Denka Kogyo Co., Ltd.). While keeping the two bottles in an open state, one bottle was allowed to stand for 24 h under normal temperature and normal humidity (NN) conditions, i.e., at a temperature of 25° C. and a relative humidity of 50%, whereas another bottle was allowed to stand for 24 h under high temperature and high humidity (HH) conditions, i.e., at a temperature of 35° C. and a relative humidity of 85%. Thereafter, the toner and carrier in each bottle were mixed together for 5 min under the same conditions as described above using a tumbler mixer, and the amount of charge on the toner in each bottle was measured using "q/m Meter" commercially available from EPPING Corporation.

PRODUCTION EXAMPLE 1

Production of Polyester Resin A

Under a nitrogen atmosphere, 8320 g of polyoxypropylene (2.2)-2,2-bis(4-hydroxyphenyl)propane, 80 g of polyoxyethylene(2.0)-2,2-bis(4-hydroxyphenyl)propane, 1592 g of terephthalic acid and 32 g of dibutyl tin oxide as an esterification catalyst were reacted with each other under normal pressures at 230° C. for 5 h, and further reacted under reduced pressure. After the obtained reaction product was cooled to 210° C., 1672 g of fumaric acid and 8 g of hydroquinone were added thereto to conduct reaction therebetween for 5 h, and further the reaction was conducted under reduced pressure, thereby obtaining a polyester resin A. The polyester resin A had a softening point of 110° C., a glass transition point of 66° C., an acid value of 24.4 mg KOH/g, and a number-average molecular weight of 3760.

PRODUCTION EXAMPLE 2

Production of Polyester Resin B

A four-neck flask equipped with a nitrogen inlet tube, a dehydration tube, a stirrer, and a thermocouple was charged with 17500 g of polyoxypropylene(2.2)-2,2-bis(4-hydroxyphenyl)propane, 16250 g of polyoxyethylene(2.0)-2,2-bis(4-hydroxyphenyl)propane, 11454 g of terephthalic acid, 1608 g of dodecenyl succinic anhydride, 4800 g of trimellitic anhydride and 15 g of dibutyl tin oxide, and the contents of the flask were reacted at 220° C. under a nitrogen atmosphere while stirring until the softening point determined according to ASTM D36-86 reached 120° C., thereby obtaining a polyester resin B. The polyester resin B had a softening point of 123° C., a glass transition point of 65° C., an acid value of 21.0 mg KOH/g and a number-average molecular weight of 2230.

PRODUCTION EXAMPLE 3

Production of Master Batch 1

Seventy parts by weight of fine particles of the polyester resin A obtained in Production Example 1 and 30 parts by weight (in terms of pigment) of a slurry pigment of copper phthalocyanine ("ECB-301"; solid content: 46.2% by weight) available from Dai-Nichi Seika Co., Ltd., were charged into a Henschel mixer, and mixed with each other for 5 min to obtain a wet mixture. The resulting mixture was charged into a kneader-type mixer and gradually heated. The resin was melted at a temperature of about 90 to 110° C., and the molten mixture was kneaded in the condition that water was still present therein, and further continuously kneaded at a temperature of 90 to 110° C. for 20 min while evaporating water therefrom.

The resulting kneaded material was continuously kneaded at 120° C. to evaporate a residual water therefrom, and dehydrated and dried, and further continuously kneaded at a temperature of 120 to 130° C. for 10 min. After cooling, the obtained kneaded material was further kneaded with a heated three-roll mill, cooled and coarsely crushed, thereby obtaining a high-concentration colored composition in the form of coarse particles containing 30% by weight of a blue pigment (master batch 1). The resulting composition was placed on a slide glass, and heat-melted. As a result of observing the resulting melted composition using a microscope, it was confirmed that the pigment particles were entirely finely dispersed in the composition, and no coarse particles were observed therein.

PRODUCTION EXAMPLE 4

Production of Resin Emulsion

A mixed resin composed of 320 g of the polyester resin A, 210 g of the polyester resin B and 100.2 g of the master batch 1 (the mixed resin obtained by mixing and melting the polyester resin A, the polyester resin B and the resin contained in master batch 1 at such a mixing ratio had a softening point of 114° C. and a glass transition temperature of 64° C.), 6.0 g of polyoxyethylene oleyl ether "EMULGEN 430" (HLB: 16.2) available from Kao Corporation, 24.0 g of an aqueous sodium dodecylbenzenesulfonate solution "NEOPELEX G-65" available from Kao Corporation, and 252 g of a 5 wt % potassium hydroxide aqueous solution as a neutralizing agent, were dispersed at 95° C. in a 5 liter-stainless steel pot while stirring with a paddle-shaped stirrer at a rate of 250 r/min. After reaching 95° C., the contents of the pot were stirred for 2 h, and then 1118 g of deionized water was added dropwise thereto at a rate of 6.0 g/min while stirring with the paddle-shaped stirrer at a rate of 200 r/min. The obtained reaction mixture was passed through a wire mesh having a 200 mesh screen (opening: 105 μm) to obtain a resin emulsion containing fine resin particles. The resin particles in the resulting resin emulsion had a volume-median particle size ($D_{50}$) of 0.170 μm and a solid content of 31.5% by weight. No resin components remained on the wire mesh.

EXAMPLE 1

Four hundred grams of the resin emulsion obtained in Production Example 4 and 75 g of deionized water were charged into a 2-liter container, and mixed with each other at room temperature. The pH of the resulting emulsion was 6.3. Then, an aqueous solution prepared by dissolving 6.30 g of ammonium sulfate (molecular weight: 132.14) as an aggregating agent in 104 g of deionized water (pH: 6.1; 0.25 millimol/L) was added dropwise to the mixture at room temperature for 15 min while stirring with the paddle-shaped stirrer at a rate of 100 r/min. Thereafter, the resulting mixed dispersion was heated at a rate of 1° C./5 min to form aggregated particles. The dispersion was heated until reaching 85° C. at which the temperature was fixed and the dispersion was stirred for 10 min, and then the heating was stopped.

The resulting dispersion was gradually cooled to room temperature, and then subjected to a suction filtration step, a washing step and a drying step to obtain fine colored resin particles. The thus obtained fine colored resin particles had a volume-median particle size ($D_{50}$) of 4.7 μm.

Next, a hydrophobic silica ("TS530" commercially available from Wacker Chemical Corp.; number-average primary particle size: 8 nm) was externally added in an amount of 1.0 part by weight on the basis of 100 parts by weight of the fine colored resin particles using a Henschel mixer to obtain a cyan toner. The resulting cyan toner was loaded to a commercially available full-color printer to form printed images. As a result, it was confirmed that the obtained printed images were good. Meanwhile, the cyan toner had a glass transition temperature of 57° C.

EXAMPLE 2

The same procedure as in Example 1 was repeated except that the dispersion was heated until reaching 85° C. at which the temperature was fixed, and the heating was stopped after the elapse of 1 h, thereby preparing toner particles. As a result, it was confirmed that the resulting fine colored resin particles had a volume-median particle size ($D_{50}$) of 5.0 μm.

The silica was externally added to the thus obtained fine colored resin particles in the same manner as in Example 1, thereby obtaining a cyan toner. The resulting cyan toner was loaded to a commercially available full-color printer to form printed images. As a result, it was confirmed that the obtained printed images were good. Meanwhile, the cyan toner had a glass transition temperature of 57° C.

EXAMPLE 3

The same procedure as in Example 1 was repeated except that the dispersion was heated until reaching 85° C. at which the temperature was fixed, and the heating was stopped after the elapse of 2 h, thereby preparing toner particles. As a result, it was confirmed that the resulting fine colored resin particles had a volume-median particle size ($D_{50}$) of 5.2 μm.

The silica was externally added to the thus obtained fine colored resin particles in the same manner as in Example 1, thereby obtaining a cyan toner. The resulting cyan toner was loaded to a commercially available full-color printer to form printed images. As a result, it was confirmed that the obtained printed images were good. Meanwhile, the cyan toner had a glass transition temperature of 57° C.

EXAMPLES 4 TO 6

The same procedures as in Examples 1 to 3 were respectively repeated except that the aggregating agent was replaced with 5.09 g of ammonium chloride (molecular weight: 53.50), thereby preparing toner particles and cyan toners. The resulting cyan toners were respectively loaded to a commercially available full-color printer to form printed images. As a result, it was confirmed that the obtained printed images were good. Meanwhile, the cyan toners had a glass transition temperature of 56° C.

EXAMPLES 7 TO 9

The same procedures as in Examples 1 to 3 were respectively repeated except that the aggregating agent was replaced with 20.0 g of tetraethyl ammonium bromide (molecular weight: 210), thereby preparing toner particles and cyan toners. The resulting cyan toners were respectively loaded to a commercially available full-color printer to form printed images. As a result, it was confirmed that the obtained printed images were good. Meanwhile, the cyan toners had a glass transition temperature of 56° C.

EXAMPLES 10 TO 12

The same procedures as in Examples 1 to 3 were respectively repeated except that the aggregating agent was replaced with 30.7 g of tetrabutyl ammonium bromide (molecular weight: 238), thereby preparing respective toner particles and cyan toners. The resulting cyan toners were respectively loaded to a commercially available full-color printer to form printed images. As a result, it was confirmed that the obtained printed images were good. Meanwhile, the cyan toners had a glass transition temperature of 56° C.

COMPARATIVE EXAMPLES 1 TO 3

The same procedures as in Examples 1 to 3 were respectively repeated except that the aggregating agent was replaced with 7.0 g of calcium chloride dihydrate, thereby preparing toner particles and cyan toners. The resulting cyan toners were respectively loaded to a commercially available full-color printer to form printed images. As a result, it was confirmed that reversal of a cleaning blade was caused owing to cleaning defect. Meanwhile, the cyan toners had a glass transition temperature of 56° C.

COMPARATIVE EXAMPLES 4 TO 6

The same procedures as in Examples 1 to 3 were respectively repeated except that the aggregating agent was replaced with 7.1 g of potassium chloride, thereby preparing toner particles and cyan toners. The resulting cyan toners were respectively loaded to a commercially available full-color printer to form printed images. As a result, it was confirmed that the cyan toners had a poor chargeability, and the obtained printed images suffered from much fogging. Meanwhile, the cyan toners had a glass transition temperature of 55° C.

COMPARATIVE EXAMPLES 7 TO 9

The same procedures as in Examples 1 to 3 were respectively repeated except that the aggregating agent was replaced with 45.2 g of "SUNNYSOL B-50" (laurylbenzyldimethyl ammonium chloride; number-average molecular weight: 370) available from Kao Corporation, thereby preparing toner particles and cyan toners. The resulting cyan toners were respectively loaded to a commercially available full-color printer to form printed images. As a result, it was confirmed that the cyan toners had a poor chargeability, and no printed images were obtainable. Meanwhile, the cyan toners had a glass transition temperature of 55° C.

The toners thus obtained in Examples 1 to 12 and Comparative Examples 1 to 9 were subjected to measurements of circularity, particle size and charge amount. The results are shown in Table 1.

TABLE 1

| | Circularity | | | Volume-median | Charge amount (μC/g) | |
|---|---|---|---|---|---|---|
| | Aggregating time | | | particle size | 25° C. | 35° C. |
| | 10 min | 1 h | 2 h | (μm) | 50% RH | 85% RH |
| Example 1 | 0.90 | — | — | 4.7 | −13.8 | −10.9 |
| Example 2 | — | 0.97 | — | 5.0 | −14.1 | −10.1 |
| Example 3 | — | — | 0.99 | 5.2 | −15.4 | −10.6 |
| Example 4 | 0.92 | — | — | 5.1 | −12.4 | −10.4 |
| Example 5 | — | 0.96 | — | 5.7 | −12.9 | −10.1 |
| Example 6 | — | — | 0.98 | 6.2 | −13.0 | −9.7 |
| Example 7 | 0.91 | — | — | 4.9 | −15.2 | −11.1 |
| Example 8 | — | 0.97 | — | 5.6 | −15.7 | −11.5 |
| Example 9 | — | — | 0.99 | 6.8 | −15.9 | −11.8 |
| Example 10 | 0.90 | — | — | 5.7 | −14.2 | −13.4 |
| Example 11 | — | 0.97 | — | 8.4 | −15.3 | −13.5 |
| Example 12 | — | — | 0.99 | 9.8 | −16.8 | −13.2 |
| Comparative Example 1 | 0.98 | — | — | 4.9 | −19.8 | −15.1 |
| Comparative Example 2 | — | 0.99 | — | 22.7 | −16.0 | −12.9 |
| Comparative Example 3 | — | — | 0.99 | 39.8 | −15.3 | −12.5 |
| Comparative Example 4 | 0.94 | — | — | 4.8 | −6.9 | −3.1 |
| Comparative Example 5 | — | 0.96 | — | 4.8 | −6.8 | −3.0 |
| Comparative Example 6 | — | — | 0.96 | 5.0 | −6.2 | −3.5 |
| Comparative Example 7 | 0.91 | — | — | 12.7 | −3.7 | −2.2 |
| Comparative Example 8 | — | 0.97 | — | 30.1 | −3.3 | −2.3 |
| Comparative Example 9 | — | — | 0.99 | 35.7 | −3.3 | −2.5 |

What is claimed is:

1. A process for producing a toner, comprising the following steps:

(1) emulsifying a resin binder which is present in a substantially organic solvent-free composition which comprises the resin binder, the resin binder comprising a polyester, in an aqueous medium to prepare an emulsion of the resin binder; and (2) adding a water-soluble nitrogen-containing compound having a molecular weight of 350 or less to the emulsion obtained in the previous step to aggregate emulsified particles contained in the emulsion.

2. The process according to claim 1, wherein the emulsion of the resin binder upon adding the water-soluble nitrogen-containing compound having a molecular weight of 350 or less thereto has a pH of 5 to 8.5 as measured at 25° C.

3. The process according to claim 1, wherein a concentration of the water-soluble nitrogen-containing compound having a molecular weight of 350 or less in the emulsion of the resin binder is from 0.01 to 0.5 mol per 1 L of water contained in the emulsion.

4. The process according to claim 1, wherein an aqueous solution containing 10% by weight of the water-soluble nitrogen-containing compound having a molecular weight of 350 or less has a pH of 4 to 6 as measured at 25° C.

5. The process according to claim 1, wherein the water-soluble nitrogen-containing compound comprises a quaternary ammonium salt.

6. The process according to claim 1, wherein the aggregating step of the resin binder is carried out in the presence of a surfactant which is present in an amount of 5 parts by weight or less on the basis of 100 parts by weight of the resin binder.

7. The process according to claim 1, wherein the polyester comprises an acid component containing at least an aromatic carboxylic acid and an aliphatic carboxylic acid.

8. The process according to claim 1, wherein the resin binder has an acid value of 6 to 35 mg KOH/g.

9. A method for controlling a shape of toner particles, comprising adding a water-soluble nitrogen-containing compound having a molecular weight of 350 or less to an emulsion of a resin binder comprising a polyester which is prepared by emulsifying the resin binder which is present in a substantially organic solvent-free composition comprising the resin binder in an aqueous medium, and aggregating and coalescing emulsified particles contained in the emulsion.

10. The process according to claim 1, wherein the content of the polyester in the resin binder is at least 80% by weight.

11. The process according to claim 1, wherein the aqueous medium comprises at least 95% by weight of water.

12. The process according to claim 1, wherein the resin binder is dispersed in the aqueous medium by adding an aqueous alkali solution thereto.

13. The process according to claim 1, wherein the emulsion in step (1) comprises emulsified particles having a volume-median particle size ($D_{50}$) of from 0.02 to 2 μm.

14. The process according to claim 1, wherein the emulsion in step (1) has a solid content of 7 to 50% by weight.

15. The process according to claim 1, wherein the water-soluble nitrogen-containing compound comprises an ammonium salt.

16. The process according to claim 1, wherein the water-soluble nitrogen-containing compound comprises at least one of ammonium sulfate, ammonium chloride, tetraammonium bromide, and tetrabutylammonium bromide.

17. The process according to claim 1, wherein the water-soluble nitrogen-containing compound is present in an amount 3.5 to 40 parts by weight, based on 100 parts by weight of the resin binder.

18. The process according to claim 1, which comprises, after step (2), a step (3) in which the aggregated particles are heated and unified thereby forming unified particles.

19. The process according to claim 18 wherein the unified particles are subjected to a liquid-solid separation step, a washing step and a drying step.

20. The process according to claim 1, wherein the substantially organic solvent-free composition additionally comprises an anionic or cationic surfactant, and optionally a nonionic surfactant.

21. The process according to claim 20, wherein the nonionic surfactant is present.

22. The process according to claim 21, wherein the anionic surfactant is present.

23. The process according to claim 21, wherein the cationic surfactant is present.

* * * * *